US007403181B2

(12) United States Patent
Moon

(10) Patent No.: US 7,403,181 B2
(45) Date of Patent: Jul. 22, 2008

(54) LIQUID CRYSTAL DISPLAY WITH AN ADJUSTING FUNCTION OF A GAMMA CURVE

(75) Inventor: Seung-Hwan Moon, Seoul (KR)

(73) Assignee: Samsung Electronics Co., Ltd. (KR)

( * ) Notice: Subject to any disclaimer, the term of this patent is extended or adjusted under 35 U.S.C. 154(b) by 176 days.

(21) Appl. No.: 10/154,919

(22) Filed: May 28, 2002

(65) Prior Publication Data

US 2002/0180680 A1 Dec. 5, 2002

Related U.S. Application Data

(60) Provisional application No. 60/295,022, filed on Jun. 4, 2001.

(30) Foreign Application Priority Data

Jun. 2, 2001 (KR) ..... 2001-30945

(51) Int. Cl.
*G09G 3/36* (2006.01)

(52) U.S. Cl. ..... 345/87; 345/88; 345/89

(58) Field of Classification Search ..... 345/690, 345/87–104, 211

See application file for complete search history.

(56) References Cited

U.S. PATENT DOCUMENTS 6,275,207 B1 * 8/2001 Nitta et al. ..... 345/89
6,542,143 B1 * 4/2003 Ozawa ..... 345/98
6,580,410 B1 * 6/2003 Nishimura et al. ..... 345/89
6,593,934 B1 * 7/2003 Liaw et al. ..... 345/590
6,633,343 B2 * 10/2003 Ito et al. ..... 348/674
6,654,028 B1 * 11/2003 Yamakawa ..... 345/690
6,801,178 B2 * 10/2004 Nitta et al. ..... 345/89

FOREIGN PATENT DOCUMENTS

| | | |
|---|---|---|
| JP | 09-281943 | 10/1997 |
| JP | 10-187127 | 7/1998 |
| JP | 11-231833 | 8/1999 |
| JP | 11-327496 | 11/1999 |
| KR | 10-0700864 | 10/2001 |

* cited by examiner

*Primary Examiner*—Jimmy H Nguyen
(74) *Attorney, Agent, or Firm*—MacPherson Kwok Chen & Heid LLP

(57) ABSTRACT

A liquid crystal display is provided with a liquid crystal module. An external picture signal source outputs RGB gray scale signals for displaying picture images. The liquid crystal display module is adapted to the RGB gray scale signals to control a gamma curve. The liquid crystal display module outputs one or more rigid positive/negative gray scale voltages, and one or more variable positive/negative gray scale voltages on the basis of the controlled gamma curve, thereby displaying the desired picture images.

18 Claims, 10 Drawing Sheets

LIQUID CRYSTAL DISPLAY WITH AN ADJUSTING FUNCTION OF A GAMMA CURVE

CROSS REFERENCE TO RELATED APPLICATION

This Application is based on U.S. Provisional Application No. 60/295,022 filed on Jun. 4, 2001, herein incorporated by reference in its entirety.

BACKGROUND OF THE INVENTION (a) Field of the Invention

The present invention relates to a liquid crystal display and a method of driving the same and, more particularly, to a liquid crystal display which controls a gamma curve to be adapted to the input gray scale data, thereby displaying a high contrast screen image without any loss in the gray scale data.

(b) Description of the Related Art

Generally, in the case of liquid crystal displays, the required number of gray scale voltages is in direct proportion to the number of data bits. For instance, three bits of data correspond to eight gray scale voltages. Recently, it has been proposed that six or eight bits of data might be used for the display application, and hence, the required number of gray scale data should be increased as much.

Meanwhile, it is difficult to make all of such increased number of gray scale voltages in a separate manner. Therefore, the drive IC for the liquid crystal display receives only eight or nine gray scale voltages from the outside while producing the intermediary gray scale voltages in situ by way of resistance division.

For instance, ten gray scale voltages V0 to V9 are input from the outside, and the intermediary voltage values are generated within the drive IC in accordance with a predetermined rule. The sequence of the gray scale voltage values is inclined while forming a curve. As the light transmission of the liquid crystal is made in a nonlinear manner, it should be corrected to obtain a uniform light transmission characteristic. This is called the "gamma correction," and the curve used for the gamma correction is called the "gamma curve."

FIGS. 1A to 1C are graphs illustrating such gamma curves where the range of brightness is indicated as a function of the range of gray scale data. As shown in FIG. 1A, the usual TFT LCD module is established to have a gamma curve of $\gamma=2.2$.

However, such a rigid gamma curve irrespective of the input gray scale data involves several disadvantages.

In the case of a relatively bright screen image such as a scene of seashore, most of the input gray scale data involve high brightness and hence, contrast becomes to be deteriorated over the entire screen area. That is, as shown in FIG. 1B, the brightness range becomes shorter, resulting in deteriorated contrast.

As shown in FIG. 1C, in the case of a relatively dark screen image such as a scene of forest, most of the input gray scale data involve low brightness and hence, contrast again becomes to be deteriorated over the entire screen area.

For this reason, in most of LCD monitors or graphic cards, it is established that the user himself can directly select and use a suitable gamma curve.

In case the user mainly makes use of a bright screen, the gamma constant is established to be more than 2.2. By contrast, in case the user mainly uses a dark screen, the gamma constant is established to be less than 2.2. In this way, the brightness range becomes to be widened, thereby enhancing the contrast.

However, the above-like technique of controlling the gamma curve involves the following problems.

As the gamma curve is fixedly established or manually controlled, the gamma curve control should be made one by one at the respective display screen states. In the case of $\gamma>2.2$, the dark display screen becomes to be darker while deteriorating the contrast. By contrast, in the case of $\gamma<2.2$, the bright display screen becomes to be brighter while deteriorating the contrast.

Furthermore, in the case of $\gamma>2.2$, the gray scale data is taken away by a predetermined amount so that data loss is made at the color area close to black. By contrast, in the case of $\gamma<2.2$, the gray scale data is added up by a predetermined amount so that data loss is made at the color area close to white. This makes it impossible to express all of the desired gray scale data.

For instance, when zero (0) to sixty three (63) gray scale data are displayed, the gray scale data may be shifted through adding up or taking away four (4) gray scale data. In this case, zero to third gray scale data close to full black, or sixtieth to sixty third gray scale data close to full white are lost.

As the gamma curve control is made in larger scale, the amount of data irrelevant to the desired gray scale expression is increased as much.

SUMMARY OF THE INVENTION

It is an object of the present invention to provide a liquid crystal display which can control a gamma curve without any loss in gray scale data.

It is another object of the present invention to provide a method of driving the liquid crystal display.

These and other objects may be achieved by a liquid crystal display with the following features.

The liquid crystal display receives RGB gray scale signals from the outside, and displays picture images on the basis of the received RGB gray scale signals. The liquid crystal display is provided with a liquid crystal display module. The liquid crystal display module is adapted to the RGB gray scale signals to control a gamma curve, and outputs one or more variable gray scale voltages on the basis of the controlled gamma curve.

According to one aspect of the present invention, the liquid crystal display module includes a D/A converter for converting digital type RGB gray scale data from the picture signal source into analog type gray scale signals. A gray scale voltage generation unit transforms the analog type gray scale signals into a gamma curve with a predetermined gamma constant, and outputs one or more rigid or variable gray scale voltages on the basis of the gamma curve.

According to another aspect of the present invention, the liquid crystal display module includes a gray scale voltage generation unit. The gray scale voltage generation unit transforms analog type gray scale signals from the picture signal source into a gamma curve with a predetermined gamma constant, and outputs one or more rigid or variable gray scale voltages on the basis of the gamma curve.

According to still another aspect of the present invention, the liquid crystal display module includes a screen brightness determination unit, and a gray scale voltage generation unit. The screen brightness determination unit checks the RGB gray scale data from the picture signal source to sense the level of the screen brightness, and outputs a control voltage depending upon the sensed brightness level. The gray scale voltage generation unit transforms the control voltage into a gamma curve with a predetermined gamma constant, and outputs one or more rigid or variable gray scale voltages on the basis of the gamma curve.

The transformation of the control voltage into the gamma curve is linearly or non-linearly made depending upon the predetermined gamma constant. The transformed gamma curve is placed at a high, middle and low levels, and the inter-level distance at the central area of the gamma curve is larger than, or the same as the interlevel distance at the side area thereof. The gamma constant is greater than the gamma constant related to the middle gray scale level when the brightness level of the display screen is higher than the brightness level of the middle gray scale level, and smaller than the gamma constant related to the middle gray scale level when the brightness level of the display screen is lower than the brightness level of the middle gray scale level.

The screen brightness determination unit includes a square wave output unit, and an analog conversion unit. The square wave output unit computes the average value of the gray scale data input from the outside for 1H, and outputs a predetermined duty signal based on the average value of the gray scale data. The analog conversion unit analog-converts the duty signal from the square wave output unit into a control voltage, and outputs the control voltage to the gray scale voltage generation unit.

The square wave output unit includes an addition unit for adding up the respective RGB gray scale data, and outputting the sum of gray scale data. A 1 line addition unit adds up the sum of gray scale data for 1H, and outputs the sum of gray scale data for 1H. A division unit divides the sum of gray scale data for 1H by 3, and outputs the data portion among the divided gray scale data corresponding to a predetermined MSB. A counting unit sequentially down-counts the MSB data, and outputs the down-counted number. A duty signal generation unit outputs a square wave bearing a predetermined duty based on the down-counted number.

The square wave output unit further includes a pixel data conversion unit for assigning a weight to any one of the RGB gray scale data.

The liquid crystal display includes a plurality of gate lines, a plurality of data lines crossing over the gate lines while being insulated from the gate lines, and pixels formed in a matrix shape at the area surrounded by the gate and data lines with switching circuits connected to the gate and the data lines. The method of driving the liquid crystal display includes the steps of (a) sequentially transmitting scanning signals to the gate lines, (b) receiving RGB gray scale signals from an external picture signal source to control a gamma curve while being adapted to the gray scale signals, and outputting one or more variable gray scale voltages based on the controlled gamma curve, and (c) transmitting data voltages to the data lines based on the variable gray scale voltages.

In the (b) step, one or more rigid gray scale voltages are output based on the controlled gamma curve.

The (b) step includes the sub-steps of (b-1) computing the average value of gray scale data input from the picture signal source for 1H, and outputting a predetermined duty signal based on the computed average value, (b-2) analog-converting the duty signal into a control voltage, and outputting the control voltage, and (b-3) transforming the control voltage into a gamma curve with a predetermined gamma constant, and outputting one or more variable gray scale voltages based on the transformed gamma curve.

The (b-1) step includes the sub-steps of (b-11) adding up the RGB gray scale data, (b-12) adding up the sum of gray scale data for 1H, (b-13) dividing the sum of gray scale data for 1H by 3, (b-14) extracting the data portion from the divided gray scale data corresponding to a predetermined MSB, and outputting the extracted gray scale data, (b-15) sequentially down-counting the MSB data, and outputting the down-counted number, and (b-16) outputting a square wave bearing a predetermined duty based on the down-counted number.

In the (b-3) step, one or more rigid gray scale voltages are output based on the controlled gamma curve.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1A:
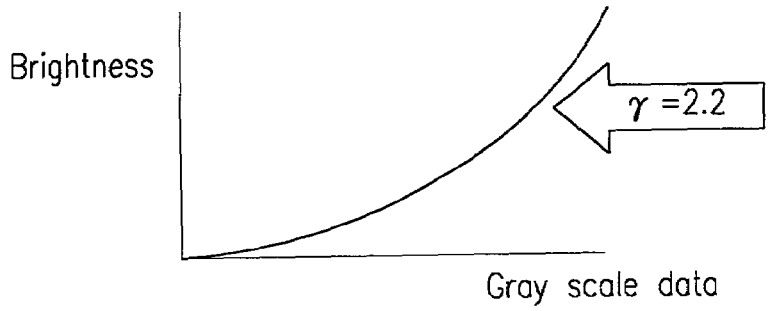
FIGS. 1A to 1C are graphs illustrating the variation in the brightness range as a function of gray scale data.
Figure 1B:
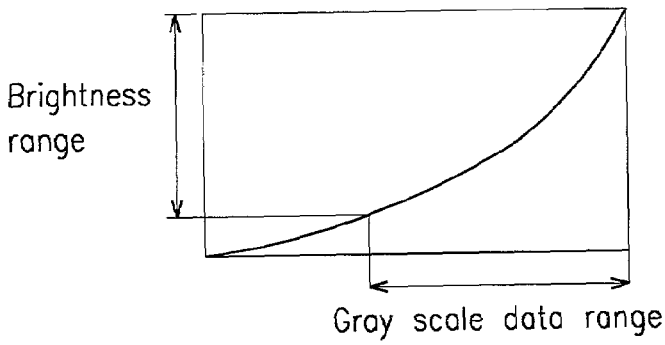
Figure 1C:
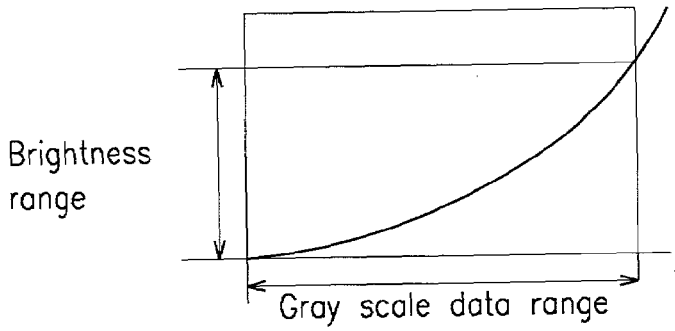
Figure 2:
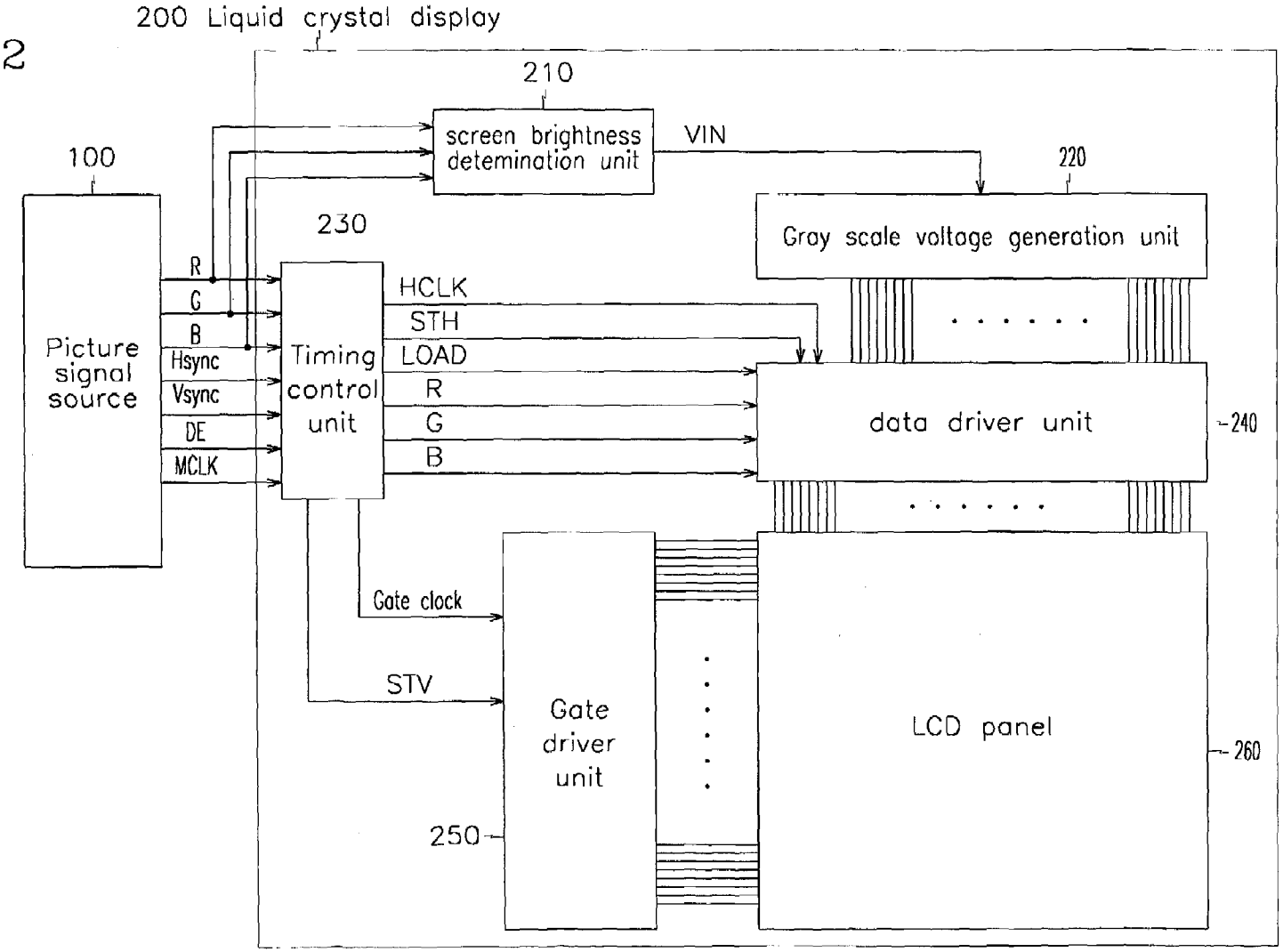
FIG. 2 is a block diagram of a liquid crystal display according to a first preferred embodiment of the present invention.

FIG. 2 is a block diagram of a liquid crystal display according to a first preferred embodiment of the present invention.

As shown in FIG. 2, the liquid crystal display includes a picture signal source 100, and an LCD module 200.

The picture signal source 100 outputs picture (RGB) signals and control signals to the LCD module 200. The control signals include a horizontal synchronization signal Hsync, a vertical synchronization signal Vsync, a data enable signal DE, and a main clock signal MCLK.

The LCD module 200 includes a screen brightness determination unit 210, a gray scale voltage generation unit 220, a timing control unit 230, a data driver unit 240, a gate driver unit 250, and an LCD panel 260. The LCD module 200 displays the desired picture image depending upon the gamma curve adapted to the gray scale signals.

Specifically, the screen brightness determination unit 210 receives the RGB gray scale signals from the picture signal source 100, and checks the brightness level of the respective gray scale signals to determine the degree of screen brightness. The screen brightness determination unit 210 outputs control voltages VIN to the gray scale voltage generation unit 220 depending upon the determined brightness degree. The output control voltage VIN is directly or inversely proportional to the determined brightness degree.

The gray scale voltage generation unit 220 receives the control voltages VIN, and controls the gamma curve based on the received control voltages VIN. The gray scale voltage generation unit 220 outputs plural numbers of gray scale voltages to the data driver unit 240 in accordance with the controlled gamma curve. In case the gray scale voltage generation unit 220 receives a control voltage directly proportional to the brightness degree, it increases the positive gray scale voltage in proportion to the control voltage while decreasing the negative gray scale voltage in inverse proportion to the control voltage.

In case the gray scale voltage is established to be $\gamma=2.2$ in the display screen of a middle gray scale, a higher control voltage is output at the display screen brighter than the middle gray scale display screen, and the gray scale generation unit 220 controls the gamma curve using the gamma constant of more than 2.2. In the display screen darker than the middle gray scale display screen, a lower control voltage is output, and the gray scale voltage generation unit 220 controls the gamma curve using the gamma constant of less than 2.2.

The timing control unit 230 outputs picture data and data control signals HCLK, STH and LOAD to the data driver unit 240, and gate control signals Gate clock and STV to the gate driver unit 250.

The data driver unit 240 receives the RGB picture data and the data control signals from the timing control unit 230, and lowers the voltage value transmitted to each pixel of the LCD panel 260 by the distance of one line depending upon the adapted gray scale voltage from the gray scale voltage generation unit 220. The gate driver unit 250 opens a pathway for transmitting the correct voltage value to each pixel.

As described above, the gray scale data from the picture signal source are analyzed to thereby determine the degree of brightness over the entire screen area, and the gray scale voltages for the LCD module are output based on the determined brightness degree. In this way, the gamma curve can be controlled at respective display screen states without any loss in the gray scale data.

Figure 3:
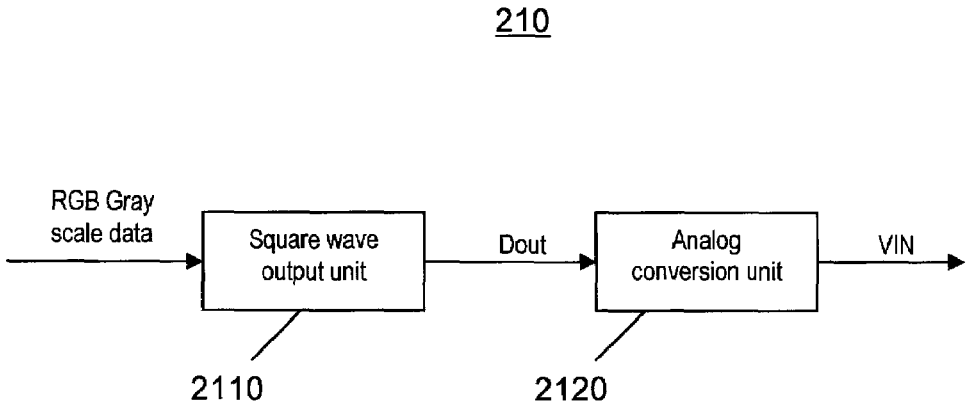
FIG. 3 is a block diagram of a screen determination unit for the liquid crystal display shown in FIG. 2.

FIG. 3 specifically illustrates the screen brightness determination unit shown in FIG. 2.

As shown in FIG. 3, the screen brightness determination unit 210 is formed with a square wave output unit 2110, and an analog conversion unit 2120. The screen brightness determination unit 210 receives gray scale data from the outside, and determines the degree of brightness over the entire screen area. The screen brightness determination unit 210 outputs the determined brightness-leveled voltage to the gray scale voltage generation unit 220.

Specifically, the square wave output unit 2110 outputs to the analog conversion unit 2120 a duty signal Dout with a duty proportional to the average value of the gray scale data input thereto for an hour of 1H.

For example, assume that in a case where the white gray scale data are input over 1H, a 100% duty signal is output. It follows that in a case where the middle gray scale data are input over 1H, a 50% duty signal is output. By contrast, when the black gray scale data are input over 1H, a 0% duty signal is output. The square wave output unit 2110 may be installed at the timing control unit 230, or structured in a way of stand alone.

The analog conversion unit 2120 receives a duty signal Dout from the square wave output unit 2110, and analog-converts the duty signal to thereby output a control voltage VIN to the gray scale voltage generation unit 220. That is, the analog conversion unit 2120 has a function of a digital-analog converter that receives a predetermined duty of square wave, and converts it into an analog typed control voltage.

Figure 4:
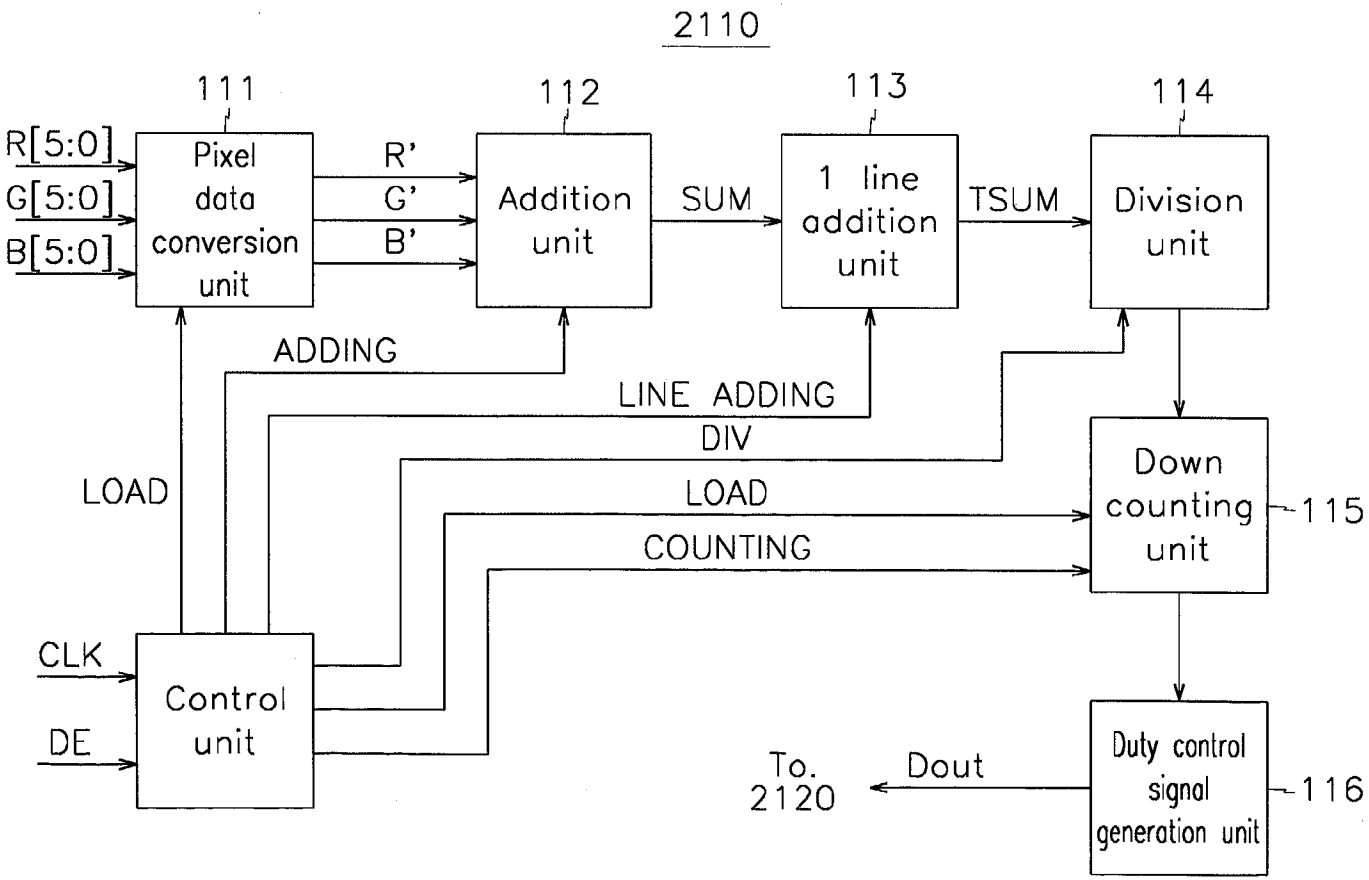
FIG. 4 is a block diagram of a square wave output unit for the screen determination unit shown in FIG. 3.

FIG. 4 specifically illustrates the square wave output unit shown in FIG. 3. As shown in FIG. 4, the square wave output unit 2110 includes a pixel data conversion unit 111, an addition unit 112, a one-line addition unit 113, a division unit 114, a counting unit 115, and a duty signal generation unit 116. The square wave output unit 2110 to outputs a predetermined duty signal Dout depending upon the average value of the gray scale data input from the outside for an hour of 1H.

The square wave output unit 2110 may be installed at the timing control unit 230 outputting a load signal LOAD, an adding signal ADDING, a line adding signal LINE ADDING, a division signal DIV, and a counting signal COUNTING, or structured in a way of stand alone.

For convenience in explanation, it is assumed that 6 bits data of '000000' are input related to the respective R and B pixel gray scale data, and 6 bits data of '111111' are input related to the G pixel gray scale data.

The pixel data conversion unit 111 receives first pixel gray scale data of R, G and B from the outside, and assigns a predetermined weight to the G pixel gray scale data based on the load signal LOAD from the timing control unit 230. The pixel data conversion unit 111 copies the G pixel gray scale data for the R and B pixel gray scale data to thereby output second pixel gray scale data of R', G' and B' to the addition unit 112. The second pixel gray scale data of R', G' and B' output to the addition unit 112 are 6 bits of '111111' at the same level as the G pixel gray scale data.

The addition unit 112 receives the second pixel gray scale data, and makes addition of the respective pixel gray scale data based on the adding signal ADDING. The addition unit 112 outputs the sum of gray scale data SUM to the 1 line addition unit 113. At this time, the sum of gray scale data is '10111101.'

The 1 line addition unit 113 makes addition with respect to the sum of gray scale data SUM for one gate line based on the line adding signal LINE ADDING, and outputs the sum of gray scale data TSUM to the division unit 114. In case one gate line is applied to an XGA-leveled resolution of 1024 RGB pixels, the sum of gray scale data TSUM is 18 bits of '101111010000000000.'

The division unit 114 divides the sum of gray scale data TSUM by '3' based on the division signal DIV, and extracts 6 bits of MSB from the divided gray scale data to output them to the counting unit 115. The gray scale data divided by '3' are '1111110000000000,' and the extracted 6 bits of MSB are '111111.'

The counting unit 115 is formed with a duty resister, and a down counter. The counting unit 115 feeds a predetermined counting number to the duty signal generation unit 116 based on the 6 bits of MSB. Specifically, the duty resister receives the 6 bits of MSB from the division unit 114 upon receipt of the load signal LOAD, and stores them. The down counter sequentially down-counts the 6 bits of MSB by one bit on the basis of the counting signal COUNTING, and feeds the down counting number to the duty signal generation unit 116.

The duty signal generation unit 116 receives the down counting number, and outputs a duty signal Dout to the analog conversion unit 2120. In case the white data are input over 1H, a 100% duty signal Dout is output. In case the middle gray scale data are input over 1H, a 50% duty signal Dout is output. By contrast, when the black data are input over 1H, a 0% duty signal Dout is output.

Alternatively, the weight assignment by way of the pixel data conversion unit 111 may be made with respect to the R or G pixel data, or omitted.

Figure 5:
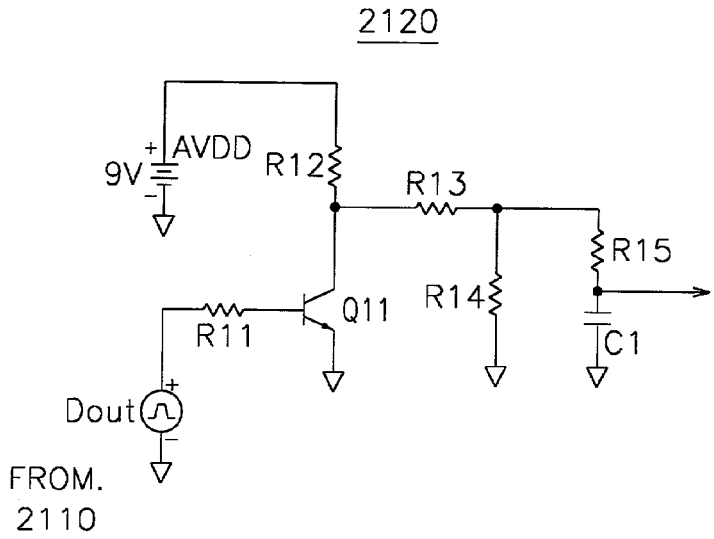
FIG. 5 is a circuit diagram of an analog conversion unit for the screen determination unit shown in FIG. 3.

FIG. 5 specifically illustrates the analog conversion unit shown in FIG. 3.

As shown in FIGS. 3 and 5, a control voltage VIN is output upon receipt of a duty signal Dout output from the square wave output unit 2110 via a first resistor R11 connected to a base terminal of a first transistor Q11.

For instance, when the duty signal Dout is in the low level, the first transistor Q11 turns off so that voltage is charged into a capacitor C1. At this time, the charge voltage is $AVDD\cdot(R_{13}/(R_{12}+R_{13}+R_{14}))$.

Meanwhile, when the duty signal Dout output from the square wave output unit 2110 is in the high level, the first transistor Q11 turns on so that the voltage charged into the capacitor C1 is discharged. The control voltage VIN being the output voltage is determined by the time constant of the resistor R15 and the capacitor C1. That is, the control voltage VIN is in proportion to the duty of the duty signal Dout and the number of pulses thereof.

Figure 6:
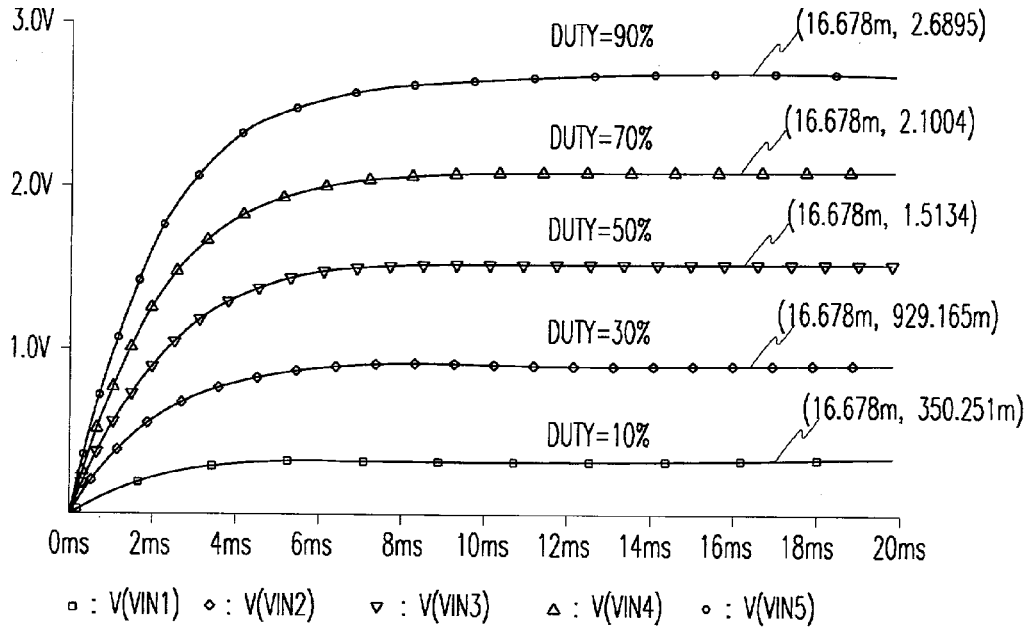
FIG. 6 is a graph illustrating the simulation results of several duty ratios per period of time.

FIG. 6 illustrates the simulation results of the respective duty ratios as a function of the period of time related to the analog conversion unit shown in FIG. 5. The component values of the analog conversion unit 2120 are established such that R11=20 kΩ, R12=1 kΩ, R13=1 kΩ, R14=1 kΩ, R15=20 kΩ, and C1=0.1 μF. In case AVDD=9V, the duty signal Dout is varied from an initial duty ratio of 0% (that is, the black gray scale) to 10%, 30%, 50%, 70%, and 90%. Under these conditions, the simulation results are obtained by way of PSPICE.

As shown in FIG. 6, the output of the control voltage VIN turns out to be in the voltage level proportional to the duty after one frame time period of 16.6 ms. Of course, the time period may be changed through controlling the time constant of R15 and C1 shown in FIG. 5.

Figure 7:
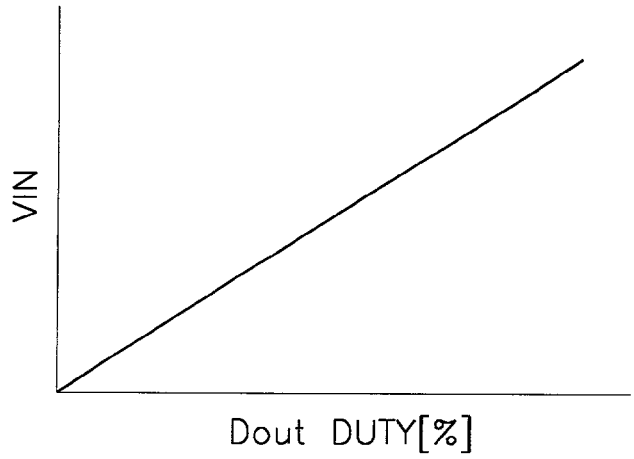
FIG. 7 is a graph abstractly illustrating the simulation results shown in FIG. 6.

The simulation results may be summarized as like in FIG. 7.

As shown in FIG. 7, the duty signal Dout is linearly proportional to the control voltage VIN. That is, the duty signal Dout has a function of a D/A converter where the average gray scale data for a display screen are converted into analog voltages.

Figure 8:
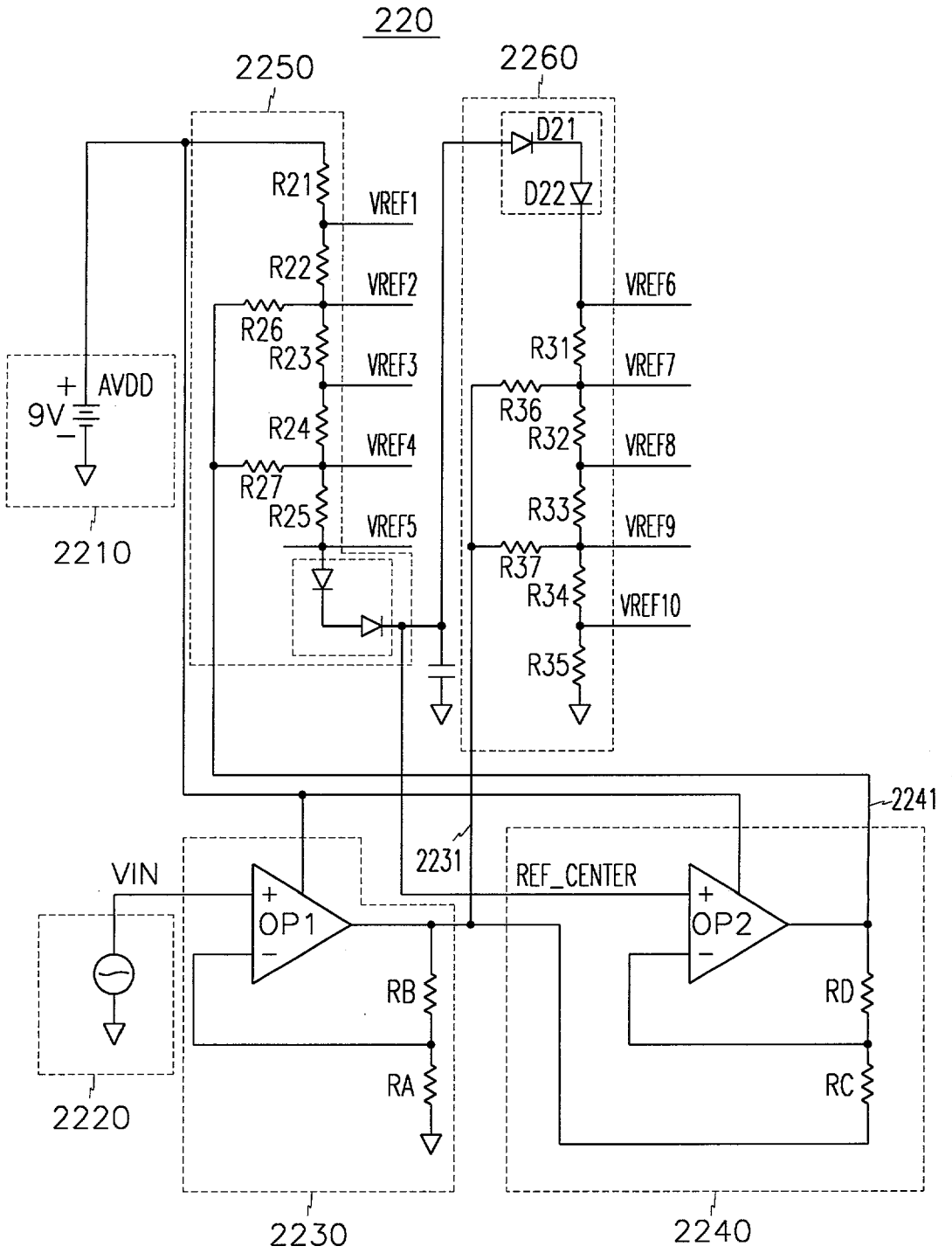
FIG. 8 is a circuit diagram illustrating a gray scale voltage generation unit for the screen determination unit shown in FIG. 3.

FIG. 8 is a circuit diagram specifically illustrating the gray scale voltage generation unit shown in FIG. 3 where plural numbers of gray scale voltages are generated through dividing the liquid crystal application voltage AVDD into resistance rows.

FIG. 8 is a circuit diagram specifically illustrating the gray scale voltage generation unit shown in FIG. 2 where plural numbers of gray scale voltages are generated through dividing the liquid crystal application voltage AVDD into resistance rows.

The first voltage source 2210 feeds a first voltage AVDD to the first amplification unit 2230, the second amplification unit 2240, and the positive gray scale voltage generation unit 2250. At this time, the first voltage AVDD being the input voltage for the LCD module is established to be 9V.

The second voltage source 2220 feeds a second voltage VIN to the first amplification unit 2230. At this time, the second voltage VIN being the control voltage is based on analog voltage of 0-3V.

The first amplification unit 2230 amplifies the second voltage VIN based on the first voltage AVDD to feed a first forcing voltage 2231 to the negative gray scale voltage generation unit 2260. Specifically, the first amplification unit 2230 positively amplifies the control voltage output from the screen brightness determination unit 210 to be $VIN\cdot(1+R_B/R_A)$. At this time, the ratio of $R_B/R_A$ is established to be '2' so that the control voltage of 3V is amplified to be maximally 9V.

The second amplification unit 2240 amplifies the reference center voltage REF-CENTER on the basis of the first voltage AVDD to thereby feed a second forcing voltage 2241 to the positive gray scale voltage generation unit 2250. At this time, the output second forcing voltage 2241 is $(1+R_D/R_C)\cdot$REF-CENTER$=(1+R_D/R_C)$.) AVDD/2.

The positive gray scale voltage generation unit 2250 includes a row of resistors R21, R22, R23, R24 and R25, and resistors R26 and R27 connected to the resistor row in parallel, and a first row of diodes D11 and D12. The positive gray scale voltage generation unit 2250 outputs rigid positive gray scale voltages $V_{REF1}$ and $V_{REF5}$ and plural numbers of variable positive gray scale voltages $V_{REF2}$, $V_{REF3}$ and $V_{REF4}$ to the data driver 240 of the LCD module 200 on the basis of the first voltage AVDD and the second forcing voltage 2241. Furthermore, the positive gray scale voltage generation unit 2250 outputs the reference center voltage REF-CENTER to the second amplification unit 2240 and the negative gray scale voltage generation unit 2260. A liquid crystal threshold voltage is generated due to the amount of voltage drop of the first row of diodes D11 and D12.

The negative gray scale voltage generation unit 2260 includes a second row of diodes D21 and D22, a row of resistors R31 to R35 linearly connected to the second diode row D21 and D22, and resistors R36 and R37 connected to the second diode row D21 and D22 in parallel. The negative gray scale voltage generation unit 2260 outputs rigid negative gray scale voltages $V_{REF6}$ and $V_{REF10}$ and plural numbers of variable negative gray scale voltages $V_{REF7}$, $V_{REF8}$ and $V_{REF9}$ to the data driver unit 240 of the LCD module on the basis of the reference center voltage REF-CENTER and the first forcing voltage 2231. A liquid crystal threshold voltage is generated due to the amount of voltage drop of the second diode row D21 and D22.

In the normally white mode LCD, the $V_{REF1}$ and the $V_{REF10}$ become to be a full black voltage, and the $V_{REF5}$ and the $V_{REF6}$ to be a full white gray scale voltage.

As described above, two rigid positive gray scale voltages and two rigid negative gray scale voltages are output, and three variable positive gray scale voltages and three variable negative gray scale voltages are output. Alternatively, it is possible that plural numbers of resistor rows may be further provided between the resistor rows outputting the variable positive gray scale voltages or the variable negative gray scale voltages to thereby output additional gray scale voltages. For example, in case the region between $V_{REFn}$ and the $V_{REFn+1}$ is divided by 16, 64 gray scale expressions may be totally made.

Figure 9:
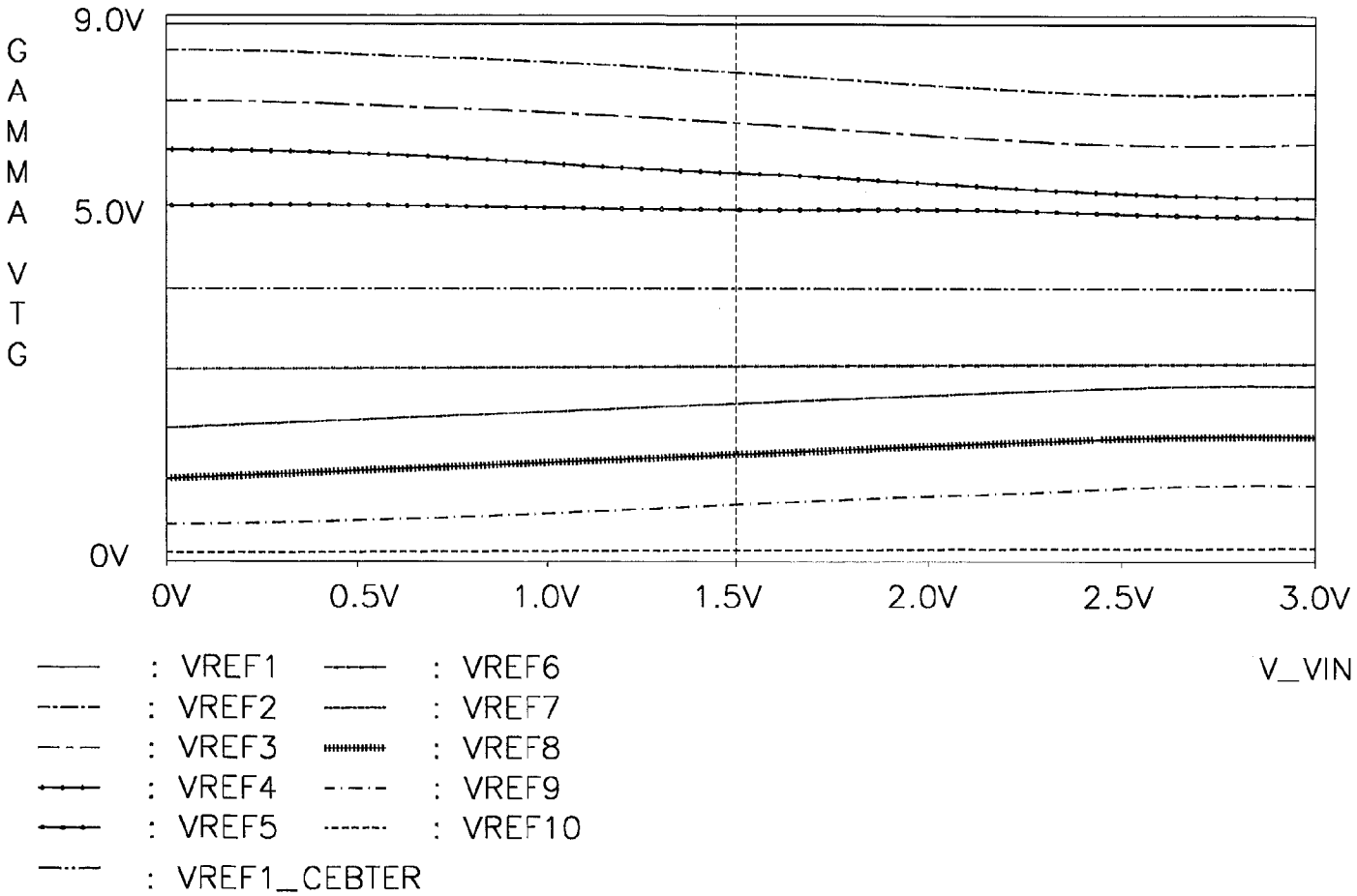
FIG. 9 is a graph illustrating the PSPICE-based simulation results when the input voltage to the gray scale voltage generation unit shown in FIG. 8 is varied in the range of 0-3V.

As shown in FIG. 9, the gamma curve at the positive gray scale voltages $V_{REF1}$ to $V_{REF5}$ and the negative gray scale voltages $V_{REF6}$ to $V_{REF10}$ is shifted depending upon the potentiality of the input control voltage VIN.

FIG. 9 illustrates the simulation results by way of PSPICE when the input voltage to the gray scale voltage generation unit shown in FIG. 8 is varied from 0V to 3V.

Assume that VIN=1.5V, and γ=2.2. As shown in FIGS. 8 and 9, in case VIN>1.5, the gamma voltage is shifted into a white voltage so that γ<2.2. In case VIN<1.5, the gamma voltage is shifted into a black voltage so that γ>2.2.

Consequently, the gamma curve shown in FIG. 9 is resulted depending upon the level of the control voltage VIN.

Figure 10:
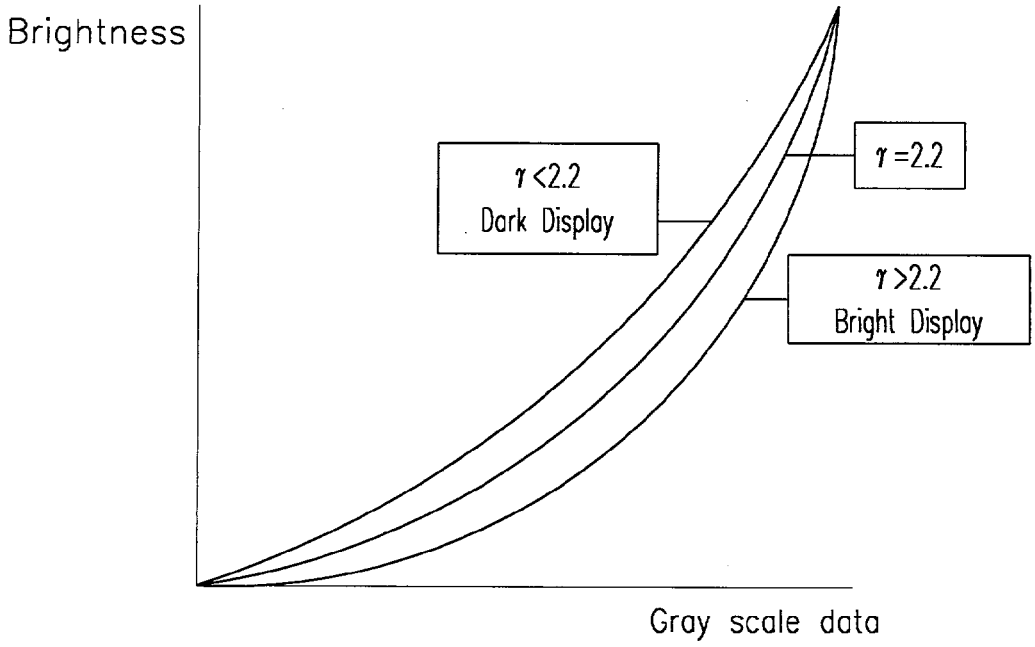
FIG. 10 is a graph illustrating the brightness levels as a function of the gray scale data.

FIG. 10 illustrates the brightness level as a function of gray scale data. Variation in the inclination degree of the gamma curve is not serious close to the low gray scale data or the high gray scale data, but becomes to be serious close to the middle gray scale data.

That is, various gamma voltages may be generated with respect to the same gray scale data while being determined by the relevant screen state. Therefore, the gamma curve can be automatically controlled depending upon the respective screen states without any loss in the gray scale data.

As described above, the gamma curve of the TFT LCD can be automatically controlled depending upon the screen brightness degree. Assume that the gamma curve is established to be γ=2.2. When the screen is biased toward a white level, the relevant gamma becomes to be γ>2.2. When the screen is biased toward a black level, the relevant gamma becomes to be γ<2.2.

In this way, a display device bearing an optimal contrast may be made while eliminating the need of manual controlling by the user case by case. Furthermore, any loss in the gray scale data is no longer generated due to the gamma curve control.

The gray scale data input from the outside are checked, and the inclination degree of the gamma curve is automatically controlled based on the checked gray scale data.

Alternatively, it is possible that the control data are input from the outside to control the gamma curve, and the inclination degree of the gamma curve is automatically controlled based on the input control data.

Figure 11:
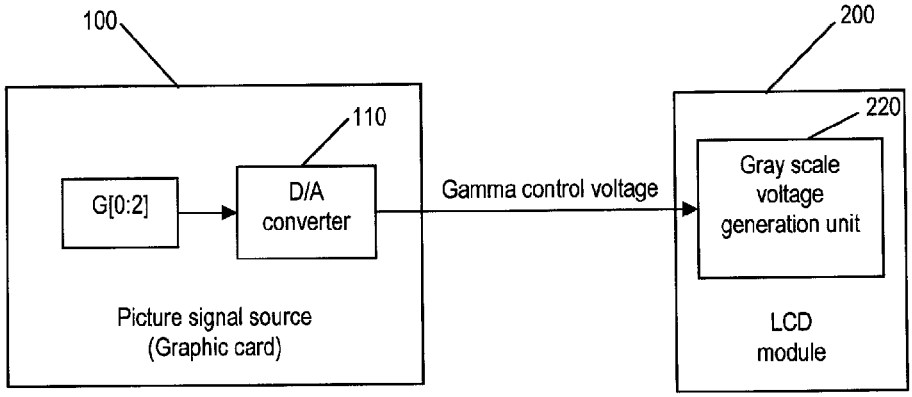
FIG. 11 is a block diagram of a liquid crystal display according to a second preferred embodiment of the present invention.

FIG. 11 illustrates a liquid crystal display according to a second preferred embodiment of the present invention where an analog interface technique is used.

As shown in FIG. 11, the liquid crystal display includes a picture signal source 100, and an LCD module 200. The liquid crystal gamma curve is controlled on the basis of the control voltage depending upon the gamma curve control data.

The picture signal source 100 is provided with a D/A converter 110. Predetermined control data are input into the converter 110 to control the gamma curve, and the converter 110 converts the input control data into analog typed gamma control voltages to output them to the LCD module 200. For instance, when it is intended to select an eight-stepped gamma curve, 3 bits of gray scale data (G[0:2]) are converted into a predetermined voltage level via the D/A converter 110.

The LCD module 200 is provided with a gray scale voltage generation unit shown in FIG. 8. The LCD module 200 changes the liquid crystal control voltage being the gray scale voltage in direct proportion to or in inverse proportion to the gamma control voltage. The gray scale voltage generation unit may bear a circuit structure shown in FIG. 8.

As described above, in relation to the LCD using the analog interface technique, even if the user directly inputs the control data for controlling the gamma curve, the gamma curve can be controlled to have a predetermined gamma constant without any loss in the gray scale data.

Figure 12:
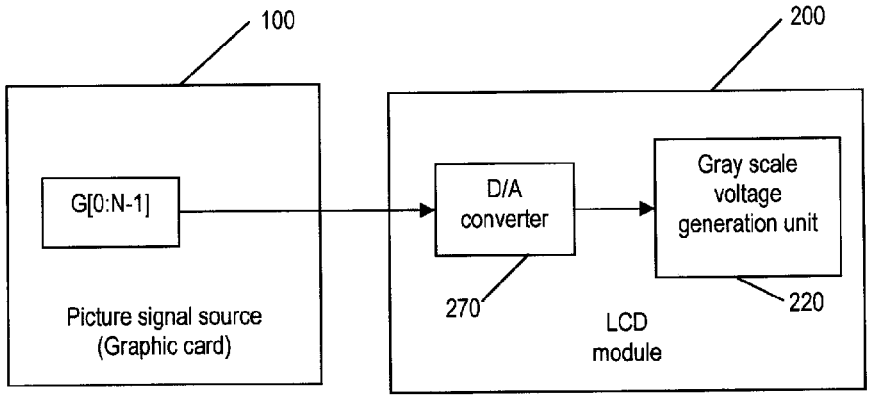
FIG. 12 is a block diagram of a liquid crystal display according to a third preferred embodiment of the present invention.

FIG. 12 illustrates a liquid crystal display according to a third preferred embodiment of the present invention where a digital interface technique is used.

As shown in FIG. 12, the liquid crystal display includes a picture signal source 100, and an LCD module 200. The liquid crystal gamma curve is controlled in the LCD module based on the gamma curve control data.

The picture signal source 100 transmits N bits of gamma curve control data G[0:N−1] to the LCD module 200. The transmission of the gamma curve control data may be made through TTL signals, or in a way of LVDS or TDMS.

The LCD module 200 includes a D/A converter 210 and a gray scale voltage generation unit 220. The converter 210 analog-converts N bits of gamma curve control data to generate a gamma control voltage, and the gray scale voltage generation unit 220 changes the liquid crystal control voltage on the basis of the gamma control voltage. In case the control voltage VIN is established to be 0-3V, the gray scale voltage generation unit 220 may make use of a circuit structure shown in FIG. 8.

The N bits of gamma curve control data may be changed into a predetermined voltage in various ways of D/A conversion.

Figure 13:
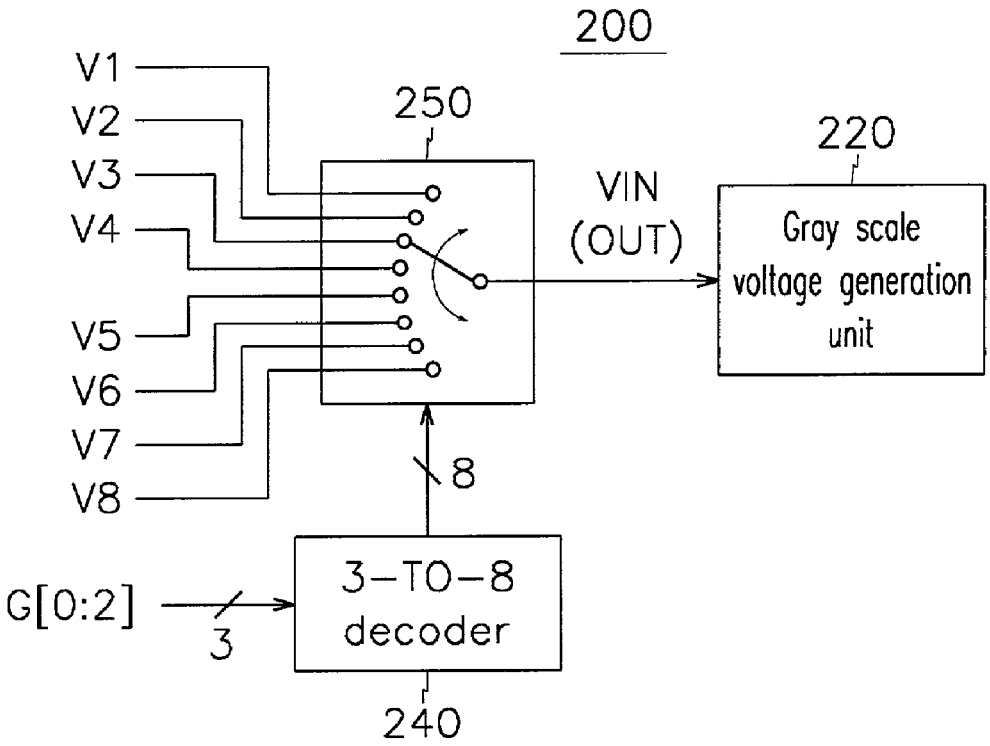
FIG. 13 illustrates the operational structure of the liquid crystal display shown in FIG. 12.

FIG. 13 illustrates an operational structure of the liquid crystal display shown in FIG. 12.

As shown in FIG. 13, when the gray scale data input from the picture signal source 100 are 3 bits, they are decoded into 8 gray scale data by way of a 3-8 decoder 240. The analog switching unit 250 selects any one of the first to eighth rigid voltages V1 to V8 input from the outside on the basis of the decoded 8 gray scale data, and outputs it to the gray scale voltage generation unit 220 as the control voltage VIN.

As described above, in the LCD using the digital interface technique, even if the user directly inputs the control data for controlling the gamma curve, the gamma curve can be controlled to have a predetermined gamma constant without any loss in the gray scale data.

Furthermore, even if the user does not directly input the control data for controlling the gamma curve, the brightness level of the picture gray scale data is automatically sensed, and the duty signal depending upon the sensed brightness level is input into the 3-8 decoder 240 shown in FIG. 13. Then, any one of the first to eighth rigid voltages V1 to V8 input from the outside is selected, and output to the gray scale voltage generation unit 220 as the control voltage VIN.

As described above, the gamma curve is automatically controlled using a predetermined gamma constant while being adapted to the gray scale data input from the outside. In this way, the resulting liquid crystal display can bear a high contrast display screen without any loss in the gray scale data.

Furthermore, the inventive liquid crystal display may bear a semi-automatic gamma curve controlling function where the automatic function and the manual function are made together.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A liquid crystal display apparatus comprising:

a liquid crystal display module configured to receive RGB picture signals from outside the liquid crystal display module and further configured to display images based on the received RGB picture signals, the liquid crystal display module comprising:

a control module configured to receive the RGB picture signals and to generate one or more control signals indicative of a gamma value, wherein the control module includes a digital to analog (D/A) converter configured to receive data indicative of the RGB picture signals and to generate the one or more control signals indicative of the gamma value; and a voltage generator unit, of the liquid crystal display module, configured to receive the one or more control signals and to generate a plurality of gray scale voltages corresponding to the gamma value, wherein the plurality of gray scale voltages corresponding to a first gamma value is different than the plurality of gray scale voltages corresponding to a second different gamma value, wherein the gamma value depends on an average value of the RGB picture signals for a predetermined period.

2. A liquid crystal display apparatus comprising:

a liquid crystal display module configured to receive RGB picture signals from a picture signal source and further configured to display images based on the received RGB picture signals, the liquid crystal display module comprising:

a gray scale voltage generation unit configured to receive one or more analog gamma control voltages from the picture signal source, the one or more analog gamma control voltages indicative of a gamma constant, the gray scale voltage generation unit further configured to use the one or more gamma control voltages from the picture signal source to generate a plurality of gray scale voltages associated with a gamma curve having the gamma constant wherein the gamma constant depends on an average value of the RGB picture signals for a predetermined period.

3. A liquid crystal display apparatus comprising:

a liquid crystal display module configured to receive RGB picture signals from a picture signal source and further configured to display images based on the received RGB picture signals, the liquid crystal display module comprising:

a screen brightness determination unit configured to determine a brightness level of a screen of the liquid display module based on the received RGB picture signals from the picture signal source, the screen brightness determination unit further configured to output a control voltage depending upon the determined brightness level; and a gray scale voltage generation unit, of the liquid crystal display module, configured to receive the control voltage and to transform the control voltage into a plurality of voltages corresponding to a gamma curve with a predetermined gamma constant, wherein the predetermined gamma constant is determined based on the determined brightness wherein the gamma constant depends on an average value of the RGB picture signals for a predetermined period.

4. The liquid crystal display of claim 1, 2, or 3, wherein the liquid crystal display module is adapted to receive the picture signals and to output automatically gamma corrected signals using a data driver unit.

5. The liquid crystal display of claim 3 wherein the control voltage is transformed into the plurality of voltages corresponding to the gamma curve linearly or non-linearly depending upon the predetermined gamma constant.

6. The liquid crystal display of claim 5 wherein the plurality of voltages corresponding to the gamma curve includes a plurality of voltages at a high, middle and low levels, wherein the plurality of voltages at the high level has a first inter-level distance, the plurality of voltages at the middle level has a second inter-level distance, and the plurality of voltages at the low level has a third inter-level distance, and wherein and the second inter-level distance is larger than, or the same as the inter-level distance at the side area thereof.

7. The liquid crystal display of claim 6 wherein the predetermined gamma constant is a mid-level gamma constant when the brightness level is determined to be a middle brightness level, and wherein the pre-determined gamma constant is greater than the mid-level gamma constant when the brightness level is determined to be greater than the middle brightness level, and wherein the pre-determined gamma constant is smaller than the mid-level gamma constant when the brightness level is determined to be lower than the mid-level brightness level.

8. The liquid crystal display of claim 3, wherein the screen brightness determination unit comprises:

a square wave output unit configured to calculate the average value of the RGB picture signals for a predetermined period, and further configured to output a predetermined duty signal based on the average value of the RGB picture signal; and an analog conversion unit configured to analog convert the duty signal from the square wave output unit into a control voltage, and further configured to output the control voltage to the gray scale voltage generation unit.

9. The liquid crystal display of claim 8 wherein the analog conversion unit comprises:

a transistor to be switched on the basis of the duty signal; and a charge/discharge unit configured to charge or discharge a liquid crystal application voltage depending upon the switching operation of the transistor, and further configured to output the analog-converted control voltage.

10. The liquid crystal display of claim 9 wherein the charge/discharge unit has a resistance (R) and a capacitance (C), and wherein the control voltage is determined by an RC time constant of the charge/discharge unit and is further in proportion to a duty and pulse number of the duty signal.

11. The liquid crystal display of claim 8 wherein the square wave output unit comprises:

an addition unit to add up respective RGB picture signals, and to add up a sum of the picture signals;

a one line addition unit to add up the sum of picture signals for a predetermined period, and further configured to output the sum of picture signals for the predetermined time;

a division unit to divide the sum of picture signals for the predetermined time by three, and further configured to output a data portion among the divided picture signals corresponding to a predetermined MSB (most significant bit);

a counting unit to sequentially down-count the MSB data, and to output the down-counted number; and a duty signal generation unit to output a square wave bearing a predetermined duty based on the down-counted number.

12. The liquid crystal display of claim 8 wherein the square wave output unit further comprises a pixel data conversion unit to assign a weight to any one of the RGB picture signals.

13. The liquid crystal display of claim 3 wherein the gray scale voltage generation unit comprises:

a first amplification unit to amplify the control voltage based on a liquid crystal application voltage and to output the amplified voltage as a first forcing voltage;

a second amplification unit to amplify a reference center voltage based on the liquid crystal application voltage and to output the amplified voltage as a second forcing voltage;

a positive gray scale voltage generation unit having a row of resistors and one or more resistors connected to the resistor row in parallel, the positive gray scale voltage generation unit to output one or more variable positive gray scale voltages based on the liquid crystal application voltage and second forcing voltage; and a negative gray scale voltage generation unit having a row of resistors and one or more resistors connected to the resistor row in parallel, the negative gray scale voltage generation unit to output one or more variable negative gray scale voltages based on the reference center voltage and the first forcing voltage.

14. The liquid crystal display of claim 13 wherein the positive gray scale voltage generation unit further comprises a row of diodes clamping the reference center voltage.

15. The liquid crystal display of claim 13 wherein the negative gray scale voltage generation unit further comprises a row of diodes clamping the reference center voltage.

16. A method of driving a liquid crystal display, the liquid crystal display comprising a plurality of gate lines, a plurality of data lines, and pixels including switching elements connected to the gate lines and the data lines, the method comprising:

(a) sequentially transmitting scanning signals to the gate lines;

(b) receiving picture signals from an external picture signal source to control generation of a plurality of voltages corresponding to a controlled gamma curve, said controlled gamma curve being adapted to the picture signals and outputting one or more variable gray scale voltages based on the controlled gamma curve; and (c) transmitting data voltages to the data lines based on the picture signals and the gray scale voltages; and wherein said receiving the picture signals and said outputting one or more variable gray scale voltages comprises:

(b-1) calculating an average value of the picture signals input from the picture signal source for a predetermined period, and outputting a predetermined duty signal based on the average value;

(b-2) analog-converting the duty signal into a control voltage, and outputting the control voltage; and (b-3) transforming the control voltage into a plurality of gray scale voltages indicative of said controlled gamma curve with a predetermined gamma constant, and outputting one or more fixed gray scale voltages of the plurality of gray scale voltages indicative of the gamma curve.

17. The method of claim 16 wherein the one or more fixed gray scale voltages of the plurality of gray scale voltages varying are output in response to the receiving of the picture signals.

18. The method of claim 16 wherein the calculating the average value comprises:

(b-11) adding up the picture signals to output the sum of picture signals;

(b-12) adding up the sum of picture signals for the predetermined period;

(b-13) dividing the sum of picture signals for the predetermined period by three;

(b-14) extracting a data portion from the divided sum of picture signals corresponding to a predetermined MSB (most significant bit), and outputting the extracted MSB data;

(b-15) sequentially down-counting the MSB data, and outputting the down-counted number; and (b-16) outputting a square wave bearing a predetermined duty based on the down-counted number.

* * * * *